US006152044A

United States Patent [19]

Bouvier

[11] Patent Number: 6,152,044

[45] Date of Patent: Nov. 28, 2000

[54] SKIER TOWING SYSTEM

[75] Inventor: Christian Bouvier, Bogeve, France

[73] Assignee: Montagner SA, Allonzier-la-Caille, France

[21] Appl. No.: 09/091,293

[22] PCT Filed: Dec. 10, 1996

[86] PCT No.: PCT/FR96/01965

§ 371 Date: Mar. 30, 1999

§ 102(e) Date: Mar. 30, 1999

[87] PCT Pub. No.: WO97/21575

PCT Pub. Date: Jun. 19, 1997

[30] Foreign Application Priority Data

Dec. 14, 1995 [FR] France ..... 95 15200

[51] Int. Cl.[7] ..... B61B 11/00

[52] U.S. Cl. ..... 104/173.2; 104/173.1; 104/178; 104/183

[58] Field of Search ..... 104/117, 173.2, 104/173.1, 178, 183

[56] References Cited

U.S. PATENT DOCUMENTS

| | | | |
|---|---|---|---|
| 3,209,703 | 10/1965 | Brebner | 104/173 |
| 3,809,369 | 5/1974 | Elsing | 254/173 R |
| 3,844,223 | 10/1974 | Brian | 104/173 |
| 4,920,892 | 5/1990 | Pesek | 104/173.2 |

FOREIGN PATENT DOCUMENTS

| | | | |
|---|---|---|---|
| 1545566 | 10/1966 | France . | |
| 517010 | 10/1965 | Switzerland | B61B 11/00 |
| 174250 | 12/1971 | Switzerland . | |

*Primary Examiner*—S. Joseph Morano
*Assistant Examiner*—Frantz Jules
*Attorney, Agent, or Firm*—Nawrocki, Rooney & Sivertson, P.A.

[57] ABSTRACT

A system for towing skiers up shallow slopes, comprising a continuously moving rope with a towing run resting on and sliding along the surface of the snow, and a return run held in a raised position by line towers. A safety device stops the system should a skier fail to let go of the towing run at the right time in the arrival area.

10 Claims, 4 Drawing Sheets

SKIER TOWING SYSTEM

The invention relates to a device for dragging people, particularly skiers, by means of a rope running continuously along a closed loop path between starting and arrival locations, each equipped with at least an end pulley, with the dragging end of the rope level with the slope so as to be seized directly by the person and its return end supported overhead above the people by pylons.

The invention is described hereinafter with respect to its application to the dragging of skiers, but it is clear that the person may be on skates, a toboggan, a skateboard or similar.

A know mechanism of the type mentioned is installed on a ski slope for beginners, particularly to enable them to become familiar with ski lifts. This mechanism is complicated, with a large number of risks of accident. It requires the presence of personnel to supervise it and to restart it, in the event of an incident. The expansion of skiing areas and the increasing number of ski lifts create the problem of transferring skiers from one installation to another or from an installation to a parking lot or residential area, and this problem is particularly difficult since skiers are used to ski lifts with high performances in terms of comfort and speed and do not readily accept having to move around, skiing or on foot shouldering their skis, in gently sloping areas. A similar problem arises in amusement parks with gently sloping downhill runs.

Document U.S. Pat. No. 3,209,703 describes a device according to the preamble to claim 1. The device described in document U.S. Pat. No. 3,209,703 has the disadvantage of possibly damaging or even cutting the rope when the safety catch on the T-bar is activated.

The goal of the present invention is to provide people with a simple and permanent means of transport, of self-service type, which makes it possible for them to move in gently sloping areas in an effortless and totally safe manner, and which is also intended for people learning to ski.

The dragging device according to the invention is characterised in that the dragging end of the rope, which is free from gripping means, rests and slides on the slope and passes the arrival location on an end pulley of a rope driving gear motor, which sends the rope back towards the return end, extending above the dragging end, and in that a safety device, disposed upstream of the end pulley at the arrival location, detects the passage of a body and actuates the stop of the rope driving gear motor, so that the latter stops before said body reaches the end pulley, the term "upstream" being defined with respect to the direction of movement of the rope.

The use of a smooth braided rope, free from tackle or other gripping means, makes it possible for the dragging end to slide directly on the snow, without the risk of catching on obstacles, and the skier may seize the rope at any location whatsoever without having to wait for the arrival of tackle. The absence of supporting pylons for the dragging end totally frees the space about this end, thus avoiding the slightest risk of catching or collision. By providing, according to the invention, a safety device at the arrival location which verifies whether the rope has been released by the skier, the presence of a supervisor becomes unnecessary. The dragging mechanism and its self-service mode of use are particularly simple and the dragging distance may be of several tens, or even hundreds of metres with speeds of displacement of more or less than 2 m/sec.

According to one development of the invention, the dragging end is maintained overhead when the installation is shut down, particularly during the night, to keep the rope from getting buried when it snows and to make slope maintenance operations easier. For this purpose, the line pylons are equipped with hooks, to catch the rope overhead or, according to an important characteristic, with winches making it possible to catch the dragging end and lift it towards the top of the line pylons.

The dragging end release detector, before the guiding and driving pulleys at the arrival location, is an essential element for the safety of the installation and this detector comprises a plate template arranged perpendicular to the rope and having a low-clearance rope passage orifice. The plate can move freely on its plane, in all directions, to follow the transverse movements of the dragging end and it is maintained at a predetermined distance from the end pulley by a support, allowing for a limited displacement in the direction of this pulley, if the skier's hand, gripping the rope, bumps against the template and drags it along. This limited displacement triggers the immediate stop of the dragging end driving gear motor, which is stopped before the template and the hand, driven by the rope, reach the end pulley. The template is preferably carried by a telescopic tube, through which the rope passes. The end of the tube, opposite to the template, is jointed by a spherical bearing at a fixed point, near the rope entry point on the end pulley. The support and the template can thus swing freely within a conical volume centred on this entry point of the pulley and follow the movements of the dragging end. The telescopic support is normally maintained in drawn-out position, for example by a spring or a breakable stop, and its shortening triggers the stoppage of the driving of the rope.

The dragging rope is advantageously a braided polyester rope, which has the advantage of a low elongation coefficient and a good resistance to ultraviolet rays and to breakage, in addition to non twisting.

According to one development of the invention, the end pulleys are fixed to end pylons above the level of the snow, particularly at an adjustable height, to maintain the rope at the starting and arrival locations above the snow at the level of the skier's hand and thus make it easier to seize and release the rope. The set-up is such that the rope, for example at a height of one or two metres near the pylon, progressively reaches the surface of the snow and rests on the latter a few metres away, beyond the starting location. The starting end pylon is vertical and aligned with the path of the rope, and it has a small width so as to give skiers access from either side of the pylon and make it possible for the rope to be seized by the skier's left hand or right hand.

The line pylons, which support the return end of the rope, are shaped like posts, laterally offset with respect to the dragging end, to enable the free passage of a skier clinging to the dragging end beside the pylon. These pylons, which are tubular for example, carry return end supporting rollers and they are equipped with the usual safety devices, such as derailment guards.

The rope driving device is carried by a vertical end pylon at the arrival location and it includes a gear motor whose shaft carries a rope driving pulley. The same pylon advantageously carries the rope tensioning device, for example a counterweight moving along the pylon.

Further advantages and characteristics will be more clearly understood upon reading the description which follows of an embodiment of the invention provided as an example and shown in the attached drawings, which:

FIG. 7 and 8 are front and side views, respectively, of a line pylon;

Figure 1:
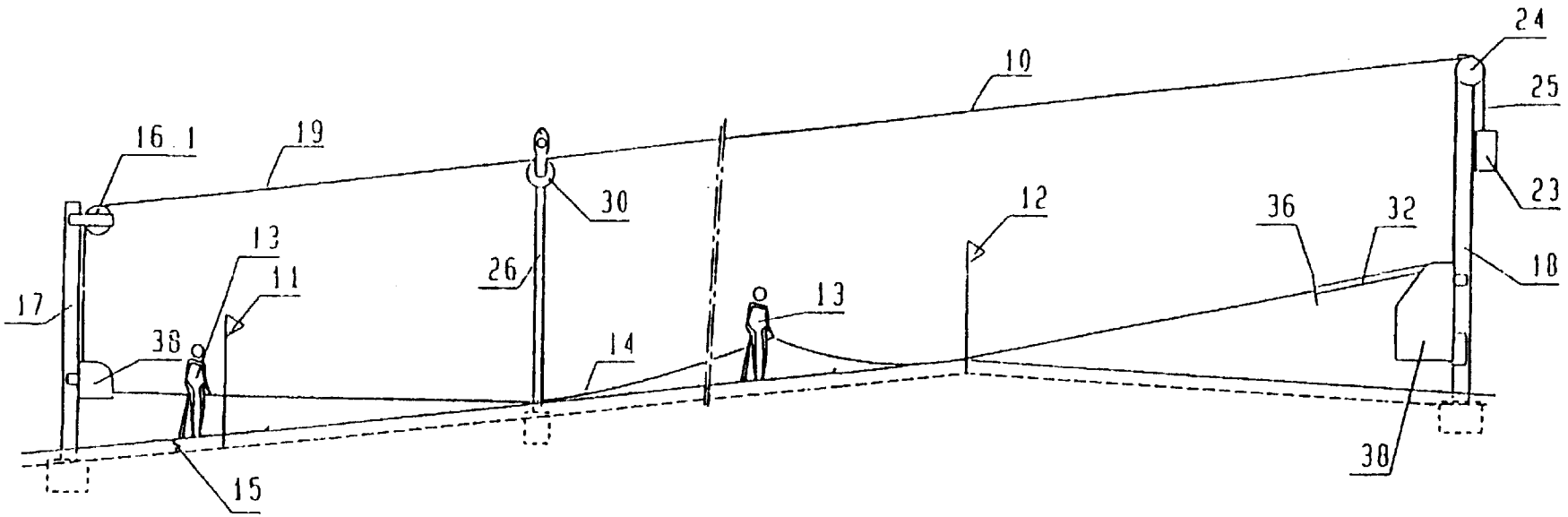
FIG. 1 is a schematic front view of a dragging device according to the invention.
Figure 2:
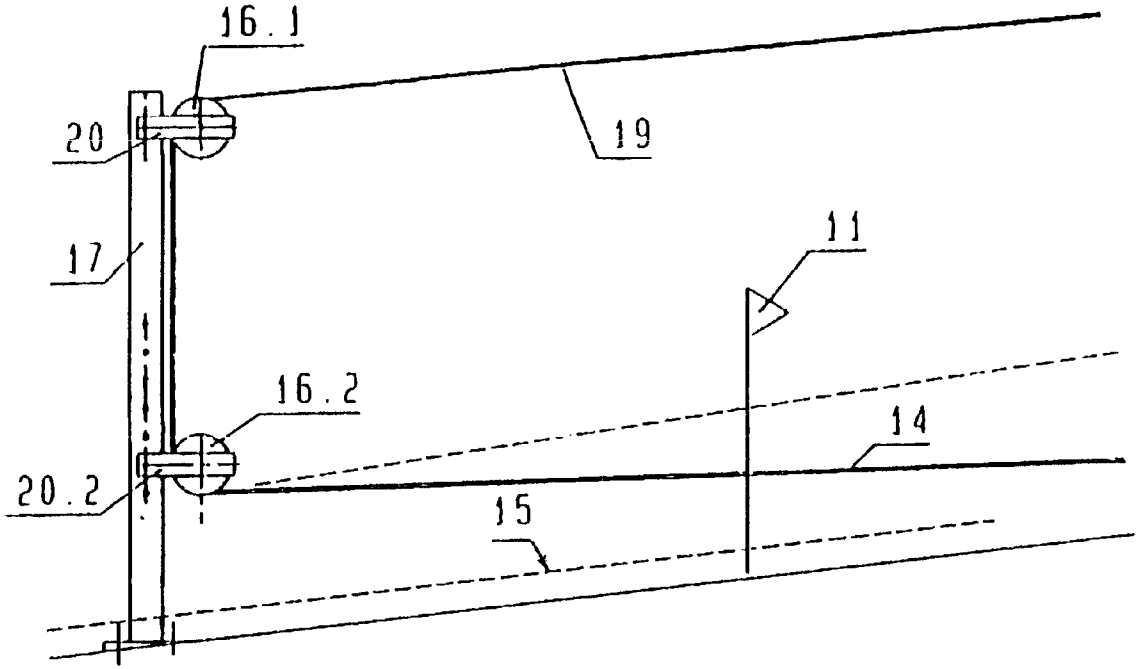
FIG. 2 is a partial, enlarged view of FIG. 1, showing the starting end pylon, with the protective hood assumed to be removed.
Figure 3:
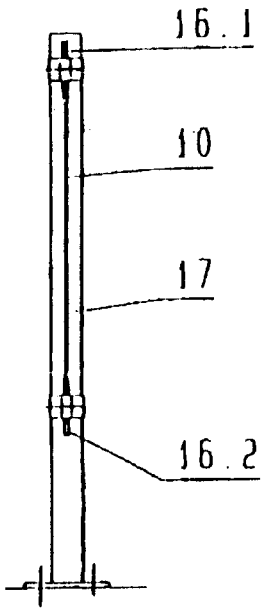
FIG. 3 is a right view of FIG. 2.
Figure 6:
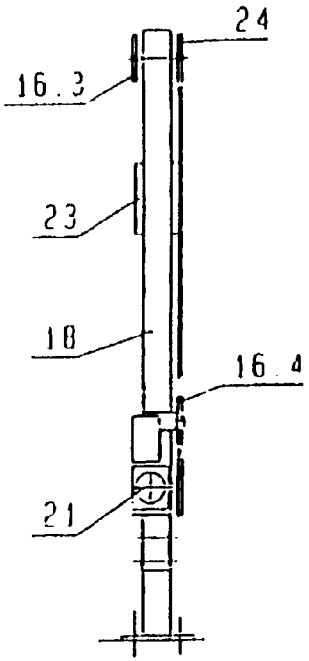
FIG. 6 is a left view of FIG. 4.
Figure 4:
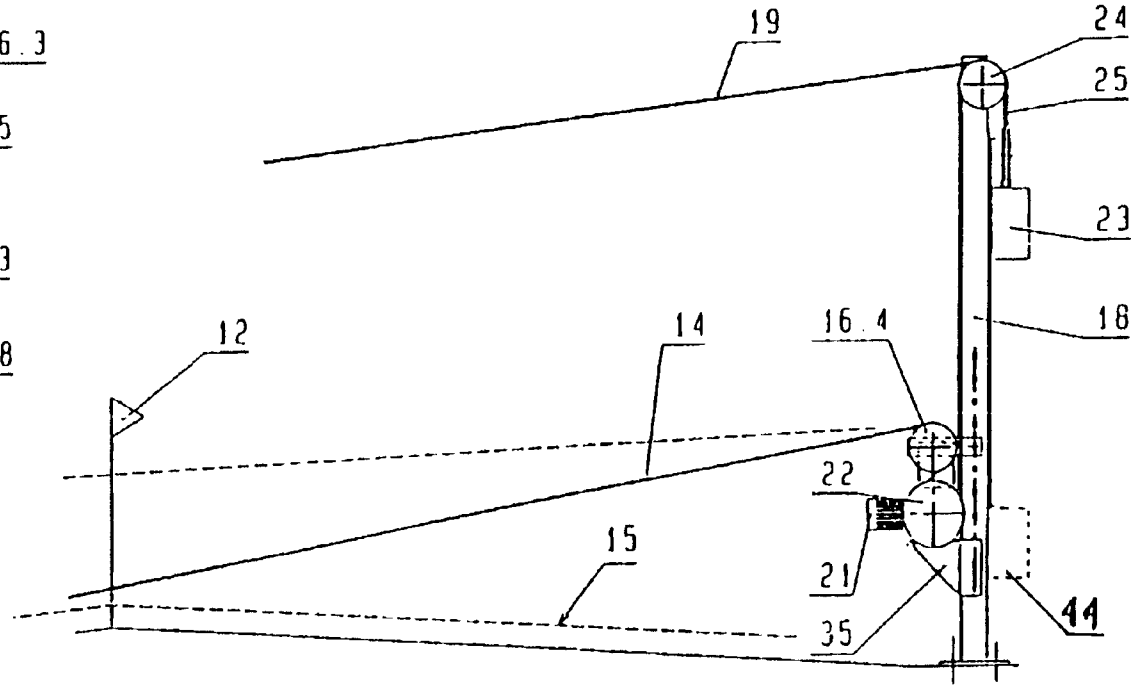
FIG. 4 is a partial, enlarged view of FIG. 1, showing the arrival end pylon, with the protective hood and the safety device assumed to be removed.
Figure 5:
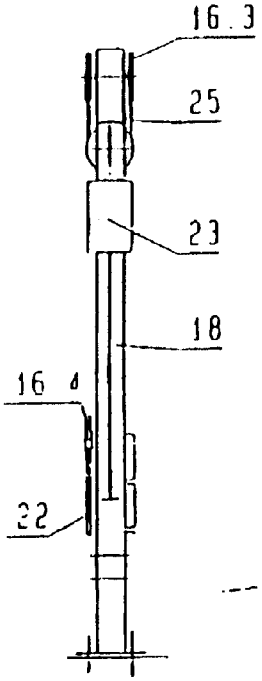
FIG. 5 is a right view of FIG. 4.
Figure 6:
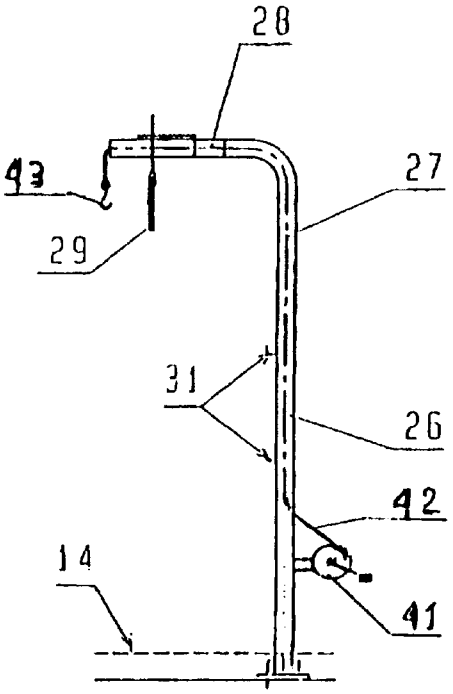
Figure 7:
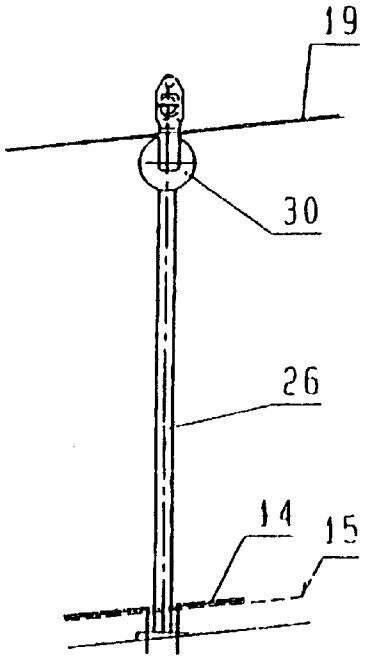

In the figures, a rope 10 extends in a closed loop between a starting location 11 and an arrival location 12 of a dragging or towing device 13 for skiers wearing skis. The dragging end 14 of the rope 10 rests and slides on the surface 15 of the snow and passes on end and return pulleys 16 carried by end pylons 17, 18 disposed at the starting location 11 and arrival location 12, respectively. The end pulleys 16 guide the rope 10, so that the return end 19 of the rope 10 extends parallel to and above the dragging end 14, for example at a height of approximately five metres, and the loop of the rope 10 extends on a virtually vertical plane. The pylon 17 at the starting location 11 is a simple vertical tubular mast, which carries two end pulleys, one 16.1 of which is fixed at the top and the other 16.2 is fixed near the base of the pylon 17. These pulleys 16.1 and 16.2 are loosely mounted on horizontal pins carried by supports 20, with that 20.2 of the base pulley 16.2 fixed to the pylon 17 overhead in an adjustable manner, so as to account for the height of the layer of snow and maintain the dragging end 14 at a predetermined distance from the surface 15 of the snow. The two end pulleys 16.1, 16.2 are fixed to the pylon 17 and the loop of the rope 10 extends on a vertical plane. The slope of the dragging run changes slightly, such that the dragging end 14 exiting the base pulley 16.2 progressively meets the surface 15 of the snow, a few metres beyond the starting location 11.

The pylon 18 at the arrival location is a similar vertical mast which carries a top end pulley 16.3 and a base pulley 16.4, as well as a motor device and a tensioning device. The motor device is a gear motor 21 with a driving pulley 22 associated with the base end pulley 16.4 so that the rope 10 embraces virtually the entire circumference of the driving pulley 22 and exits vertically towards the top of the pylon 18. The tensioning device is disposed at the top of the pylon 18 and it comprises a counterweight 23 moving vertically along the pylon 18. The rope 10 passes at the top of the pylon 18 successively on a return pulley 24, a pulley block 25, carrying the counterweight 23 and the end pulley 16.3. It is readily understood that the counterweight 23 keeps the return end 19 stretched between the two end pylons 17, 18 at a certain height and that the dragging end 14 is driven by the driving pulley 22, sliding on the snow. The base pulley 16.4 and the gear motor 21 with the driving pulley 22 are fixed on two remote supports 35, whose height of attachment to the pylon 18 may be adjusted, to account for the thickness of the layer of snow. The slope of the dragging run changes before the arrival location 12 such that the rope 10 separates from the surface of the snow 15 and progressively moves away from the latter so as to attain the height, for example two meters, of the end pulley 16.4 perpendicular to the pylon 18. The skier 13 thus releases the rope 10 instinctively at the arrival location.

One or more line pylons 26 are distributed along the line to support the return end 19 at a sufficient height so as not to hinder the skiers 13. Each line pylon 26, shaped like a post, comprises a vertical mast 27, laterally shifted with respect to the dragging end 14 and prolonged by a horizontal curved part 28, which extends transversely with respect to the line. A fork 29 of a return end 19 supporting roller 30 is suspended from this curved part 28. The mast 27 carries hooks 31, which the dragging end 14 can be hung up on at the end of the day. A more elaborate system includes a winch 41 fixed to the base of the line pylon 26, whose cable 42 extends and slides inside the tubular curved mast 27, 28 and carries, at its end exiting the post, a dragging end 14 catch hook 43.

Figure 9:
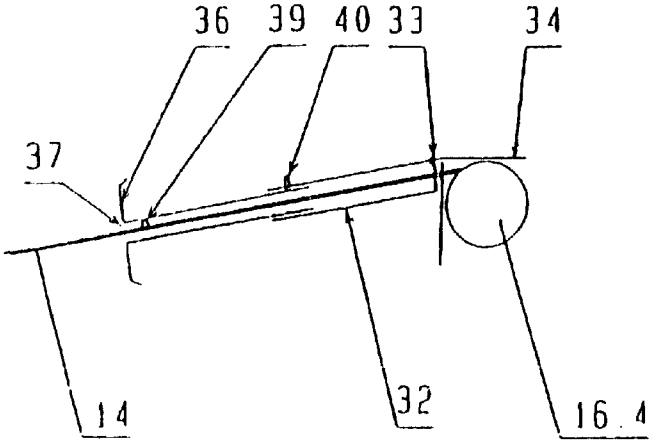
FIG. 9 is a schematic view of the safety device.

Referring more specifically to FIG. 9, it can be seen that a safety device shaped like a telescopic tube 32 is disposed before the end pulley 16.4 of the arrival pylon 18. The dragging end 14 passes inside the tube 32, which is fixed on the side of the pylon 18 by means of a ball-and-socket joint 33 to a support 34 integral with the pylon 18. This joint 33 is adjacent to the entry point of the dragging end 14 on the end pulley 16.4 or to a guiding system before this pulley 16.4, and it allows for a free motion of the telescopic tube 32 within a conical volume centred on the joint 33 to follow the lateral and upward movements of the dragging end 14. A perpendicular plate template 36 with a central orifice 37 for the low-clearance passage of the rope 10 is secured to the free end of the telescopic tube 32. During normal operation, the telescopic tube 32 is in the drawn-out position illustrated and it maintains the plate 36 at a distance from the end pulley 16.4. The telescopic tube 32 carries, near the orifice 37, a roller 39, which rests on the rope 10 and maintains the telescopic tube 32, which therefore follows the movements of the rope by means of the joint 33. The rope 10 slides freely inside the tube 32. A breakable stop 40 or a spring (not shown) maintain the telescopic tube 32 in the drawn-out position, without nevertheless opposing the shortening of the tube 32, under the effect of a body clung to the rope 10 which bumps against the plate 36 and drags it along. This shortening of the telescopic tube 32 is detected by any appropriate means, for example through the breaking of the stop 40 or the opening of a micro-contact, connected to the switch box 44, which results in the immediate stoppage of the gear motor 21 and therefore of the driving of the rope 10. The assembly is arranged so that the stoppage takes place before the body clinging to the rope 10, in this case the hand of the skier, reaches the end pulley 16.4. The system is restarted automatically, provided that the template is freed and the telescopic tube returns, under the effect of the spring, to the drawnout position, or an intervention on the part of the supervisor may possibly be required. The end pylons 17, 18 have protective hoods 38 which cover the accessible moving parts, particularly the end pulleys 16.

The operation of the dragging device emerges from the above description:

The rope 10 runs continuously, with the dragging end 14 sliding on the snow 15. The skier 13 first advances, from behind the end pylon 17 on the left or right side of the latter, towards the starting location 11 where he or she seizes the dragging end 14, clearly separated from the surface 15 of the snow. The skier is driven by the dragging end 14, maintaining the latter lifted throughout trip. The lifting force is weak, as it essentially depends on the tensile force, which is weak itself. At the arrival location, the skier releases the rope 10 and moves away from the run, which may be gently sloping. When the installation is shut down, at the end of the day, the dragging end 14 is caught on the hooks 31 or lifted by the winches 41 of the line pylons 26. The run is therefore totally cleared and accessible to ramming vehicles and, in the event that it snows, there is no risk of the rope 10 being buried. The following day it is merely necessary to adjust the height of the supports of the end pulleys 16 and release the rope 10 before restarting the installation. The usual detector is disposed at the end of the run so as to indicate an overshoot on the part of a skier 13 and trigger the stopping of the installation. A second safety device is ensured by the plate 36, which is actuated by the hand of a skier releasing the rope 10 too late. The slightest risk of an accident is thus eliminated and the device may operate in self-service mode. A braided rope 10 with a low elongation coefficient and a smooth surface limiting friction and wear will be used advantageously. A polyester rope has a good resistance to ultraviolet rays, which are very intense in mountain regions.

What is claimed is:

1. A device for dragging skiers, by means of a rope running continuously along a closed loop path between starting and arrival locations disposed along a slope, said rope having at least end pulleys, on which the rope passes, at both the starting and arrival locations, said rope further having a dragging end intermediate the starting and arrival locations of the rope which is level with the slope so as to be seized directly by the skier, and comprising a driving means for driving the rope which is provided at the arrival location, with the driving means comprising a gear motor associated with said end pulley at the arrival location, characterised in that said dragging end of the rope is free from gripping means, and further having safety means disposed upstream of the end pulley at the arrival location comprising a telescopic tube through which the rope passes, and is such that when a body, particularly a hand, which has remained clung to the rope, bumps against the telescopic tube, this results in a shortening of the latter, with the safety means further comprising means for detecting the shortening of the telescopic tube, and capable of actuating, in the event that shortening is detected, the stoppage of the driving of the rope.

2. A dragging device according to claim 1, further comprising supporting pylons supporting said rope at intervals along its path, including end pylons at the starting and arrival locations at each end of said path which define the return ends of said rope path, and characterised in that the return end of the rope at the arrival location is supported overhead above the skiers by an end one of said pylons, and further comprising a gear motor, wherein the end pulley at the arrival location is also associated with the gear motor and sends the rope back toward the starting location extending above the dragging end, the closed loop path of the rope extends on a substantially vertical plane, said device further comprising pylons, the end one of which supports the end pulley at the starting location, said pylons being equipped with means for maintaining the dragging end overhead during shutdown periods, to keep the dragging end from getting buried when it snows and to make the slope maintenance operations easier.

3. A dragging device according to claim 2, characterised in that said pylons have a mounting base, and further have maintaining means which includes winch means fixed to the base of the pylon located at the starting location which winch means is for lifting and maintaining the dragging end overhead during shutdown periods.

4. Winch means according to claim 3, characterised in that said pylons are tubular and in that the cable of the winch means slides inside the pylon.

5. A dragging device according to claim 1, characterised in that said supporting pylons are shaped like posts, and are laterally offset with respect to the dragging end to enable the free passage of a skier clinging to the dragging end beside the pylon.

6. A dragging device according to claim 1, characterised in that the telescope tube comprises pylons supporting said rope and pulleys at intervals along its path, and a flexible joint which pivotably joins one end of the tube such that the tube is joined at one end to a fixed attachment point near the rope entry point on the end pulley at the arrival location, making it possible for the telescopic tube to move freely within a conical volume centered on the joint.

7. A dragging device according to claim 6, characterised in that the means of detection comprises a breakable stop or a micro-contact.

8. A dragging device according to claim 1, characterised in that said rope is a braided polyester rope.

9. A dragging device according to claim 1, further comprising supporting pylons for each pulley at intervals along said path, characterised in that the end pulleys located at both the starting and arrival locations are fixed to corresponding end pylons above the level of the snow, particularly at an adjustable height, to make it easier for the rope to be seized by the skiers, and in that the end pylon at the starting location is aligned with the path of the rope and has a small width so as to give skiers access from either the left or right side of the pylon.

10. A dragging device according to claim 1, further comprising supporting pylons for each pulley at intervals along said path, characterised in that the end pylon positioned at the arrival location carries the gear motor driving the rope and a tensioning device for the latter.

* * * * *